United States Patent [19]

Jones et al.

[11] 4,057,195

[45] Nov. 8, 1977

[54] APPARATUS FOR PACKAGING STRAND

[75] Inventors: Bernard H. Jones; Daniel Cox; Don R. Gallagher, all of Anderson, S.C.

[73] Assignee: Owens-Corning Fiberglas Corporation, Toledo, Ohio

[21] Appl. No.: 674,478

[22] Filed: Apr. 7, 1976

[51] Int. Cl.[2] ..... B65H 54/02

[52] U.S. Cl. ..... 242/18 G; 242/18 A; 242/18 PW

[58] Field of Search ..... 242/18 G, 18 PW, 18 A; 57/34 TT

[56] References Cited

U.S. PATENT DOCUMENTS

| | | | |
|---|---|---|---|
| 3,090,570 | 5/1963 | Cunningham et al. | 242/18 G |
| 3,109,602 | 11/1963 | Smith | 242/18 G |
| 3,115,313 | 12/1963 | Cunningham | 242/18 G |
| 3,292,871 | 12/1966 | Smith et al. | 242/18 G |
| 3,924,817 | 12/1975 | Symborski | 242/18 G |

*Primary Examiner*—Jerry W. Myracle
*Assistant Examiner*—Charles Gorenstein
*Attorney, Agent, or Firm*—Ronald C. Hudgens; Kenneth H. Wetmore

[57] ABSTRACT

The present invention embraces apparatus for packaging strand. The invention comprises means for supplying a first strand and a second strand and a driven rotatable collet having a first package collection region for the first strand, a second package collection region for collecting the second strand and a temporary collection region. A strand engaging member having a recess, a first guide surface and a second guide surface, is moved along a path to move the first strand and the second strand from the package collection regions to the temporary collection region. The first guide surface is adapted to contact and guide the first strand toward the recess and the second guide surface is adapted to contact the second strand as the member is moved to move the strands to the temporary collection region. The apparatus can also include means for moving the member to move the first strand and the second strand from the temporary collection region to the package collection region. The second strand moves to its package collection region and is removed from the second guide surface while the first strand remains in the recess and then the first strand moves to its package collection region and is removed from the recess.

10 Claims, 12 Drawing Figures

APPARATUS FOR PACKAGING STRAND

BACKGROUND OF THE INVENTION

It has been a conventional practice particularly in the formation of strands of filaments from heat softenable mineral material such as glass to wind the strands of filaments upon a rotating collet at a speed desired for the attenuation of filaments of a particular diameter and when the package of wound strand is completed, the attenuation and winding operation is interrupted by the operator de-energizing the motor rotating the collecting collet, bringing the collet to a condition of rest, breaking the strand of filaments manually, and removing the strand package from the winding collet.

The operator manually places a strand free sleeve or collector upon the collet and initiates rotation of the collet to re-establish attenuation of filaments by winding. During the start up or initial period of rotation of the collet, the filaments formed have a larger size diameter than desired and have a changing size diameter until the collet is brought up to the required winding speed.

During this period the filaments are initially wound upon an extension of the collet until the collet reaches the desired winding speed at which time the skilled operator moves the strand manually into cooperative association with a traversing means which performs the function of distributing the strand material lengthwise of the collet in super imposed layers in the formation of a complete package. When the package is completed and rotation ceases, the operator removes the initially wound strand from the collet which is discarded as waste material, removes the finished package and starts the cycle again.

There has been development work in the winder field for automatic movement of strands both before and after the strand is being collected into a package. One such strand moving apparatus is the shaft with a projection for engaging the strand is shown in U.S. Pat. No. 3,090,570. Another strand moving apparatus is shown in U.S. Pat. No. 3,924,817. Still another strand moving apparatus is shown in U.S. Patent Application Ser. No. 590,756. Mechanical systems for controlling and moving strand during strand collection are needed.

SUMMARY OF THE INVENTION

The present invention embraces apparatus for packaging strand. The invention comprises means for supplying a first strand and a second strand and a driven rotatable collet having a first package collection region for the first strand, a second package collection region for collecting the second strand and a temporary collection region. A strand engaging member, having a recess, a first guide surface and a second guide surface, is moved along a path to move the first strand and the second strand from the package collection regions to the temporary collection region. The first guide surface is adapted to contact and guide the first strand toward the recess and the second guide surface is adapted to contact the second strand as the member is moved to move the strands to the temporary collection region. The apparatus can also include means for moving the member to move the first strand and the second strand from the temporary collection region to the package collection region. The second strand moves to its package collection region and is removed from the second guide surface while the first strand remains in the recess and then the first strand moves to its package collection region and is removed from the recess.

An object of the invention is improved apparatus for collecting strand into wound packages.

Another object of the invention is improved apparatus for moving strand between a package collection region and a temporary collection region.

Still another object of the invention is an improved apparatus for moving strand from a temporary collection region to deliver the strand to its package collection region.

Other objects and advantages will become apparent as the invention is described more clearly hereafter in detail with reference being made to the accompanying drawings.

These drawings are generally illustrative of the apparatus for carrying out the invention but are not to be considered as limiting the invention to the specifics there of.

DESCRIPTION OF THE PREFERRED EMBODIMENTS

Figure 1:
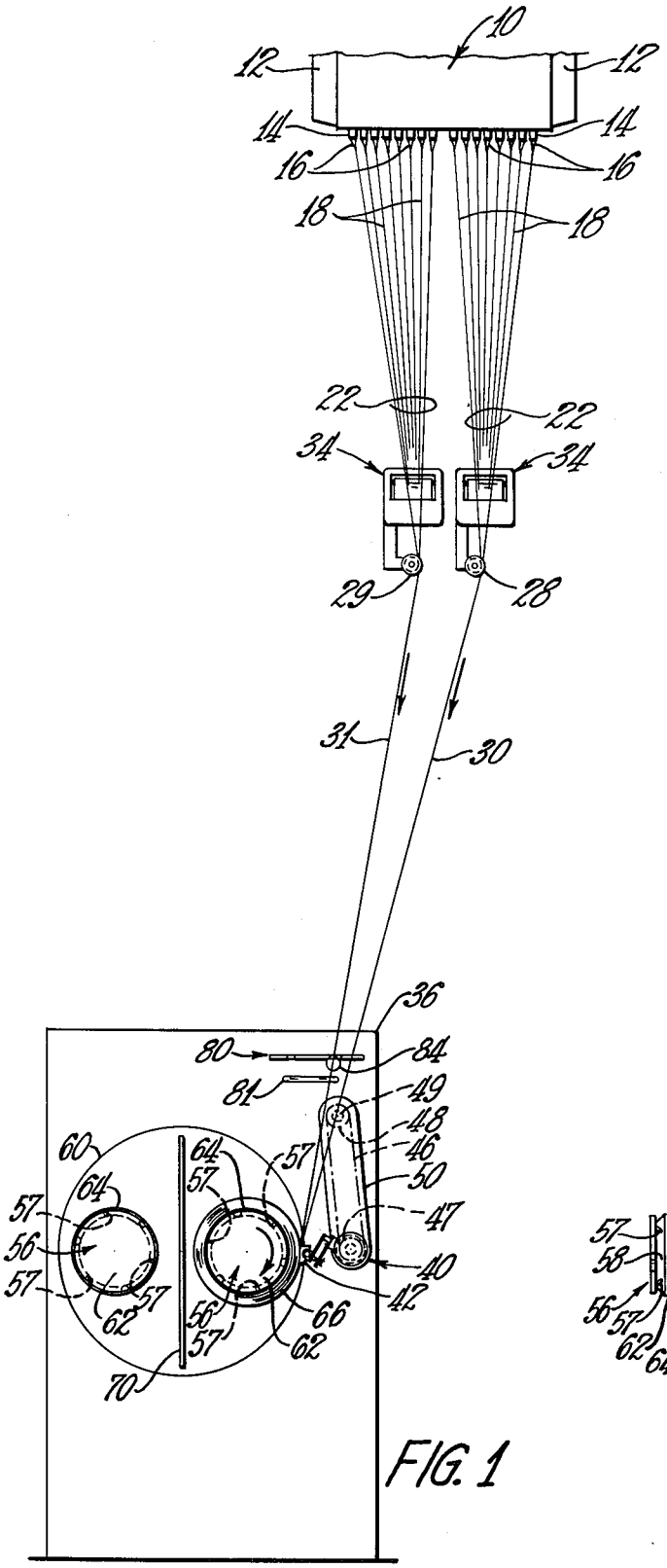
FIG. 1 is a front elevation view illustrating a form of automatic winder apparatus embodying the invention.
Figure 2:
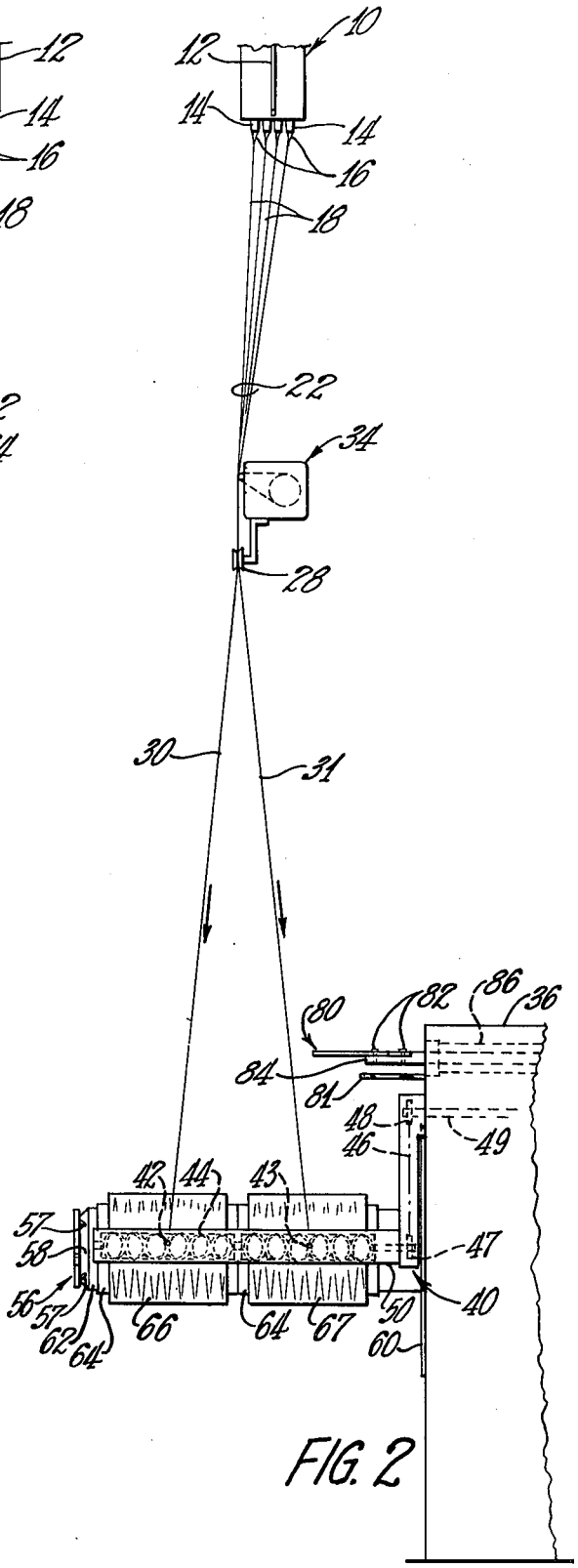
FIG. 2 is a fragmentary side elevational view of the winder apparatus illustrated in FIG. 1.

Referring to the drawings in detail and initially to FIGS. 1 and 2 there is illustrated a conventional type of stream feeder or bushing 10 containing a supply of heat softened filament forming material. The heat softened material can be a mineral material such as glass. Feeder 10 has a floor provided with a comparatively large number of orificed tips or projections 14 flowing streams of glass 16 and the streams attenuated to filaments 18 in groups 22.

The feeder is formed of any alloy of platinum and rhodium or other materals capable of withstanding the intense heat of molten glass.

The feeder is provided with terminals 12 connected with a source of electrical energy for heating the glass or other mineral or heat softenable material. The energy input is being controlled by conventional means (not shown) to maintain the material in the feeder at a proper viscosity to promote the formation of uniform streams 16.

The two groups of filaments are converged by gathering shoes 28 and 29 to form the two strands 30 and 31. The filaments of each group are coated with a lubricant size or other coating material by means of applicator arrangement 34 of conventional construction.

FIGS. 1 and 2 illustrate the automatic winding and package forming apparatus which is inclusive of housing 36 enclosing the actuating and control components for carrying out or performing the steps of the method of attenuating the filaments and automatically packaging the strands of the filaments. U.S. Pat. No. 3,408,012 describes conventional control means for such a winder. Such patent is herein incorporated by reference.

Two journally supported winding collets 62 extend from the indexible head 60 of the winder. Between the collets is a shield 70. Each of the collets is adapted to accommodate strand collecting means such as tubular sleeves 64 on which packages are wound. At the end region 56 of each collet is a temporary collection region for the strand. In this temporary collection region there is a guide surface or groove 58 and at least one pin or member 57 extending into the groove. In the embodiment shown there are three pins 57 extending into the groove.

Strands 30 and 31 are being collected into respective packages 66 and 67. The strands are being moved back and forth across the package surface by oscillator or traverse means 40. Strand 30 is guided by the guide 42 and strand 31 is guided by the guide 43. Guides 42 and 43 move laterally back and forth along the packages by the cam action of cam member 44. The cam means 44 is driven by the belt 46 and sprockets 47 and 48. Such strand oscillating means as oscillator 40 are discussed in U.S. Pat. Nos. 3,367,587 and 3,897,021 which are herein incorporated by reference. As can be seen, this type of traverse means (which is shown as an example) forms a wound package which has a cylindrical shape throughout its length.

Figure 7:
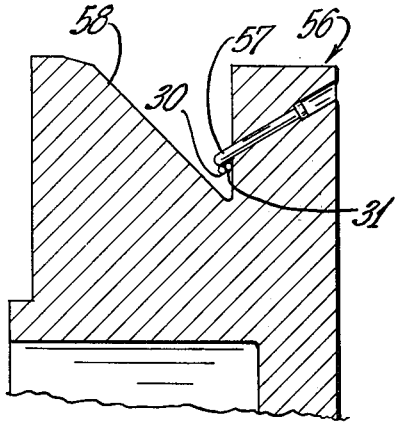
FIG. 7 is a partial sectional view of the end region of the collet shown in FIG. 1 and shows the continued movement of strand shown in FIG. 6.
Figure 8:
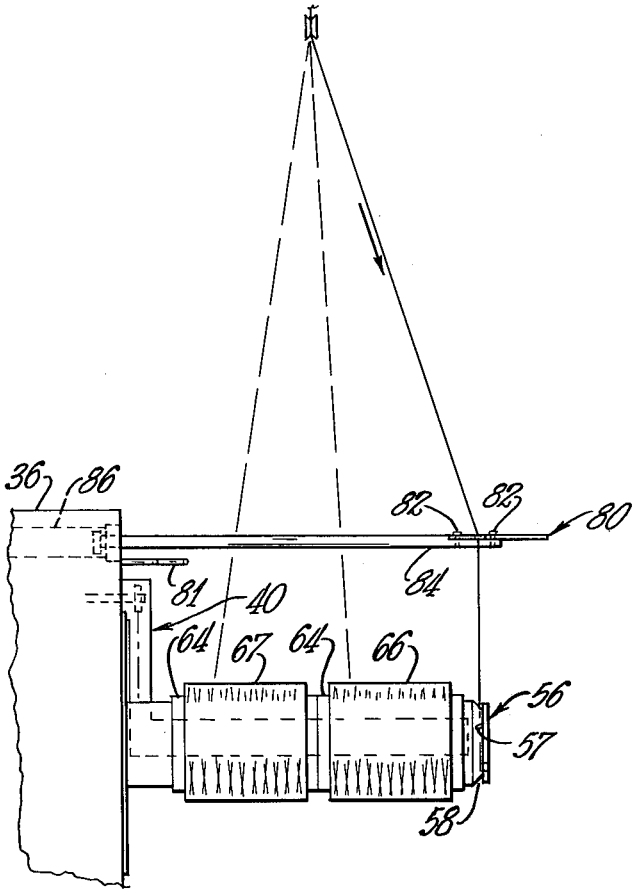
FIG. 8 is a fragmentary side elevation view illustrating the automatic winder apparatus of FIG. 1 with the strand knock-off member in its extended position.

When the two strand packages 66 and 67 have been completed the strand push-off apparatus or member 80 is activated to move the member along a path to move strands 30 and 31 from their respective package collection regions to the temporary collection region of the collet. FIG. 8 shows the push-off apparatus in its fully extended position. The strands have been contacted by push off means or member 80 and have been moved to the temporary collection region of the collet. The strands are being wound in groove 58 in end cap region 56 of the collet. The push-off member 80 is shown to be attached by screw means 82 to the support shaft 84. The support shaft moves by air cylinder means 86. Thus, member 80 is moved generally linearly, axially back and forth along the length of the collet. Strand lift-out means 81 is discussed in detail in reference to FIGS. 9 through 12. When push-off member 80 has been fully activated or extended as shown in FIG. 8 turret head 60 can be activated to transfer strands 130 and 31 from the collet having completed packages 66 and 67 to the next collet for the winding of two new packages. The automatic transfer from one collet to another is shown and will be discussed in reference to FIGS. 3 through 7.

Figure 3:
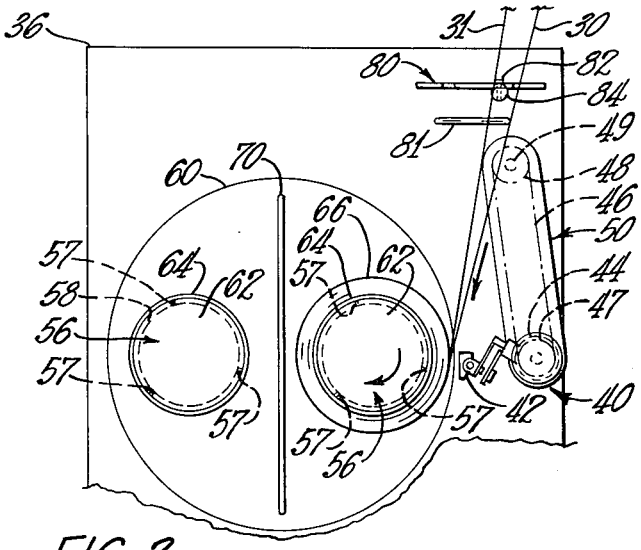
FIG. 3 is a schematic view illustrating the collection of strands to form packages with the packages shown as being substantially completed.
Figure 4:
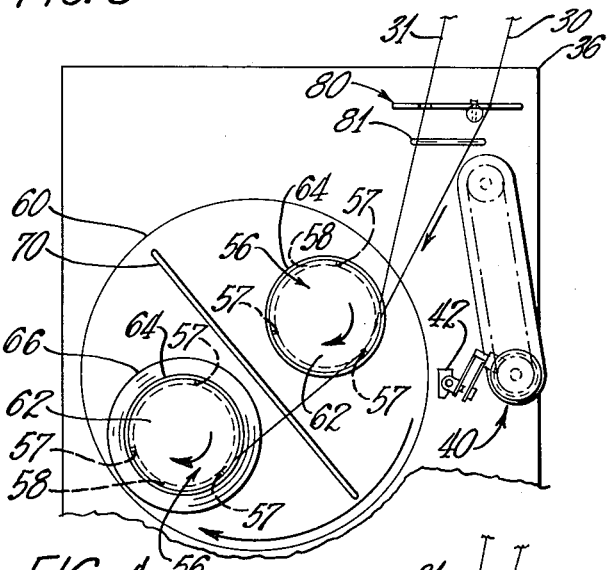
FIG. 4 is a view similar to FIG. 3 illustrating an indexing movement of the collet supporting head wherein the completed packages are moved away from the winding station and an empty collet is moved toward the winding station.
Figure 5:
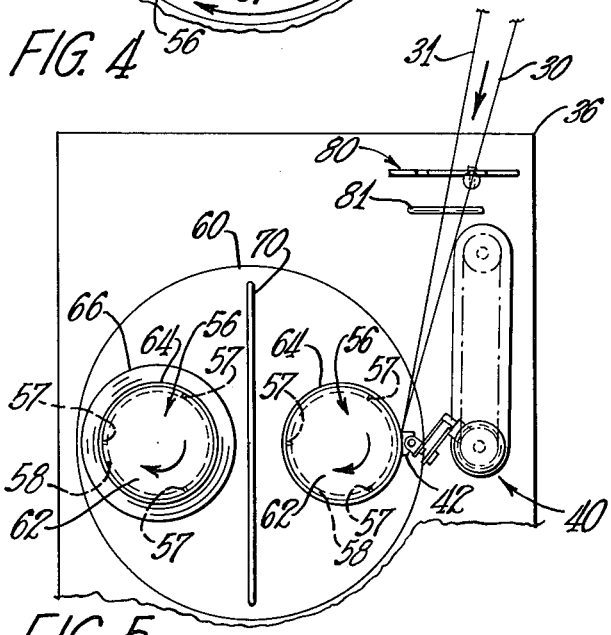
FIG. 5 is a view similar to FIG. 4 illustrating the transfer of the strands onto the empty collet.

FIGS. 3, 4 and 5 show the method of automatic transfer of strand from one collet to another on a winder like that shown in FIGS. 1 and 2. Automatic transfer of strand from one collet to another is discussed in U.S. Patent application Ser. No. 590,756. Such patent application is hereby incorporated by reference.

In FIG. 3 there are two collets 62 mounted on indexible head 60. The collet 62 on the right is shown to have completed the winding of strands 30 and 31 into wound strand packages. The strand guide 42 (strand guide 43 not being visible from this angle in this drawing) on the traverse assembly 40 is moved away from the collet with the completed square edged or cylindrical packages. Next, knock-off or push-off member 80 is extended to move strands 30 and 31 from their package collection regions to the temporary collection region at the end cap 56 of the collet. This moving of the strands to the temporary collection region by the member will be discussed in more detail in reference to FIGS. 9–12.

Figure 6:
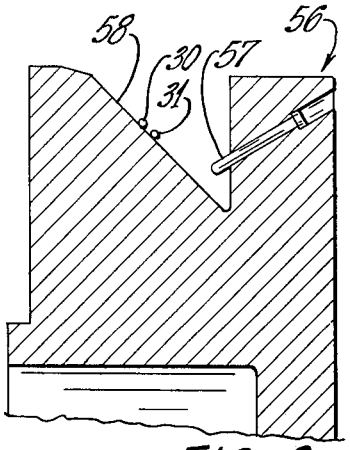
FIG. 6 is a partial sectional view of the end region of the collet shown in FIG. 1 and shows the strand movement thereon.
Figure 12:
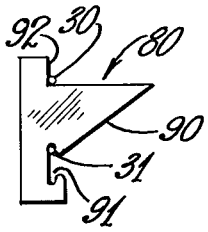
FIG. 12 is a plain view of the knock-off member showing continued movement of the strands during the extension of the member.

FIG. 4 shows knock-off member 80 in its extended position where it has moved strands 30 and 31 to the temporary collection region of the collet. As shown in FIG. 12, strand 31 is in the recess of the member and strand 30 is on the second guide surface. The strands 30 and 31 advancing to the temporary collection region of the first collet are contacted by the second rotating collet in its temporary collection region to engage the strands on member 57 to move the strands with it and thereby to begin collection of the strands in the temporary collection region of the second collet and to sever the material between the collets. As shown, indexing head 60 moves the collet having the completed packages from the winding location and moves the second collet on the head into winding location. The strands enter circumferential guide surface or groove 58 and engage pin 57 to begin collection of the strands on the second collet in the temporary collection region. FIGS. 6 and 7 show the movement of strands 30 and 31 as they enter guide surface 58 in the end cap region 56 of the collet. The strands move along the guide surface into engaging contact with the pin 57.

FIG. 5 shows the indexing of head 60 as completed. The new collet is now in winding position and the strands are being collected in their package collection regions on the collet. The knock-off or push-off member has been retracted to move the strands from the temporary collection region to the package collection regions. The inside strand 31 has been removed from member 80 by strand lift-out means 81. Strand traverse assembly 40 is back into winding position. The collet having the completed packages has been moved to the doffing position where the rotation of the collet is stopped and the packages are removed from the collet. FIGS. 9 through 12 show the movement of strand knock-off member 80 and the function of strand lift-out means or strand remover 81.

Figure 9:
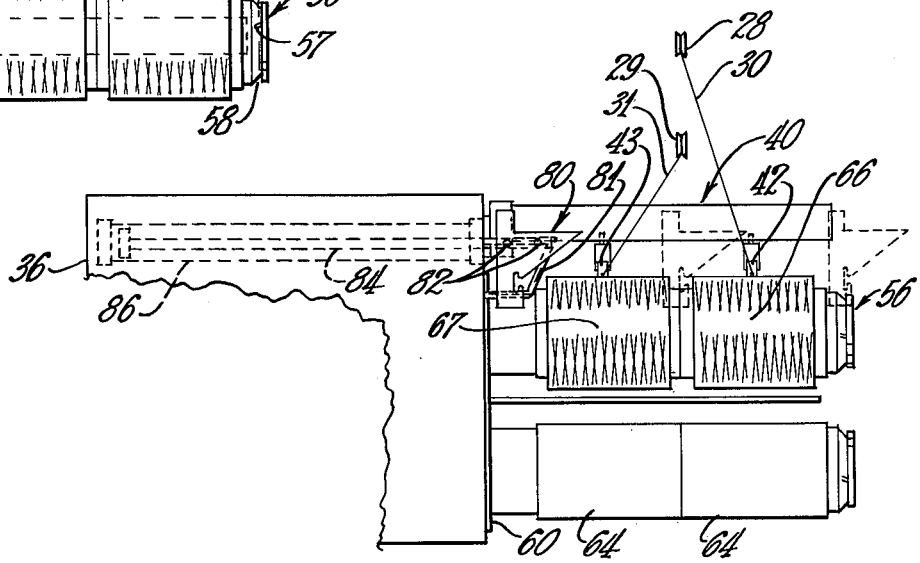
FIG. 9 is a fragmentary plain view of the automatic winder apparatus showing the strand knock-off member in several positions as it is extended.

In FIG. 9 the winder apparatus is shown with traverse assembly 40 in winding position collecting strands 30 and 31 into wound packages 60 and 67. As can be seen gathering shoes 28 and 29 are in an offset position so that strands 30 and 31 are separated one from another. As shown, knock-off member 80 is attached by screw means 82 to support shaft 84. The support shaft is extended and retracted by air cylinder 86. When the packages have been completed, shaft 84 is extended to move the knock-off member along a path axial of the collet to its extended position.

Figure 10:
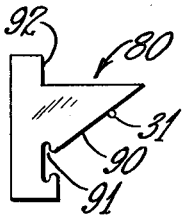
FIG. 10 is a plain view of the knock-off member showing strand movement during the extension of the member.
Figure 11:
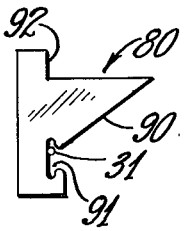
FIG. 11 is a plain view of the knock-off member showing continued strand movement during the advancement of the member.

FIGS. 10–12 show strand movement on member 80. FIG. 10 shows the knock-off member as it begins to move outwardly. The first strand 31 is contacted by first guide surface 90 as the knock-off is moved. As the knock-off moves to the center region of the collet (shown in dashed lines) first strand 31 moves along first guide surface 90 into recess 91 as shown in FIG. 11. First strand 31 is held in the recess 90 as member 80 extends further. As member 80 extends past the second package collection region second strand 30 is contacted by second guide surface 92 of the member. Thus, as the member extends to its full position both the first strand and the second strand are contacted by the member and moved outwardly to the end region of the collet. The first guide surface is at an oblique angle to the path of movement of the member. The second guide surface and the recess are traversely disposed to the path of movement of the member. The first guide surface and the second guide surface are on opposite sides of the member. The strands are kept separated one from another at the member so that when the member has been fully extended the first strand is in recess 91 and the second strand is on second guide surface 92. Once the member has been fully extended, strands 30 and 31 will be collected in the temporary collection region of the first collet so that the automatic transfer of the strand of one collet to another may take place.

After the strands have been transferred to the temporary collection region of the second collet, the member is moved to move the first strand and the second strand from the temporary collection region to the package collection regions. Second strand 30 is moved to its package collection region and is removed from the second guide surface while the first strand remains in recess 91. Then first strand 31 is moved to its package collection region and is removed from the recess. Wire lift-out means 81 removes strand 31 from the recess as the member is retracted.

The function of strand knock-off mechanism 80 is to move the strands from the package collection area of the two cylindrical or square edge packages to a temporary collection region at the end cap of the first collet, allow the strands to be transferred from the first collet to a second collet, and place the strands back into their strand oscillating or traversing mechanisms without interrupting the strand forming process and while still retaining strand integrity.

This is done by running the strands through an offset pair of upper guide shoes so the strands run in an offset arrangement. An air cylinder pushes the knock-off member out to pick up the strands and push them toward the temporary collection region on the end cap. As the knock-off or push-off member moves out, the strand traversing or oscillating mechanism moves back, releasing the strands from the traversing mechanism. The knock-off member is adapted to move along a path so that the point or front portion of the member comes between the two offset strands. This separates the strands so that each goes to a different guide surface. One strand moves along a first guide surface and is captured in a notch or recess while the other strand, the front strand, is captured and moved by a second guide surface. The inside strand is picked up by the member in its package collection region and pushed off the inside package to the region between the two packages being formed on the collet. The speed of strand attenuation is slowed by moving it from its package to the region between the packages. This change in strand speed is about one half of the package surface speed, but the change in speed is relatively slow compared to the strand speed so that it is merely a deaccelleration of the strand and does not affect the process other than to change filament diameter. As the knock-off member continues to be extended, the inside strand will begin to rub against the side of the outside square edged package. As this inside strand is pushed toward the temporary collection region on the collet, the force, F, at the edge of the outside package trying to pull the strand along with it is equal to $f_1$ times the coefficient of friction for a wet glass strand sliding on a wet glass strand. In this arrangement $f_1$ equals the tension of the strand times the sin of the angle the inside strand is bent over the outside strand package. As this angle is decreased by the guide member pushing the inside strand toward the temporary collection region on the collet, $f_1$ increases the force, F, at the edge of the outside package until it overcomes the resisting force and the inside strand pulls up onto the surface of the outside package. Also, the strand running to the outside package is picked up by the second guide surface on the member. Both strands are pushed off the outside package to the temporary collection region on the collet by the push-off member.

Once the strands have been moved to the temporary collection region of the first collet, the turret head rotates to transfer the strands from the first collet to the temporary collection region of the second collet.

After the strands have been transferred to the temporary collection region of the second collet the pushoff member retracts leaving the front strand in the package collection region on the front of the collet and pulling the inside strand captured in the recess to the inside package collection region where it is lifted out of the capture recess in the knock-off member by the lift-out wire. The outside strand moves from the temporary collection region toward its natural pulling center which is toward the outside package collection region and is picked up by the outside guide on the strand traversing mechanism. The inside strand lifted from the knock-off or push-off member by the lift-out wire at the inside region of the collet moves toward its natural pulling line in the inside package collection area and is picked up by the inside guide on the traversing mechanism. Thus, the strand transfer cycle is completed.

Having described the invention in detail, it will be understood that such specifications are given for the sake of explanation. And various modifications and substitutions other than those cited may be made without departing from the scope of the invention as defined in the following claims.

We claim:

1. Apparatus for packaging strand comprising:

a. a driven rotatable collet having a first package collection region for collecting a first strand, a second package collection region for collecting a second strand and a temporary collection region;

b. a strand engaging member having a recess, a first guide surface and a second guide surface, the first guide surface and the second guide surface being on opposite sides of the member; and c. means for moving the member along a path to move the first strand and the second strand from the package collection regions to the temporary collection region, the first guide surface being adapted to contact and guide the first strand toward the recess and the second guide surface being adapted to contact the second strand as the member is moved to move the strands to the temporary collection region.

2. The apparatus of claim 1 wherein the recess and the second guide surface are in spaced apart relationship.

3. The apparatus of claim 1 including means for moving the member to move the first strand and the second strand from the temporary collection region to the package collection regions, the second strand being moved to its package collection region and being removed from the second guide surface while the first strand remains in the recess and then the first strand being moved to its package collection region and being removed from the recess.

4. The apparatus of claim 3 including a lift-out means for removing the first strand from the recess as the first strand is moved from the temporary collection region to the first package collection region.

5. The apparatus of claim 1 wherein the path along which the member moves is axial of the collet and the first guide surface is at an oblique angle to the path of member movement.

6. The apparatus of claim 1 wherein the path along which the member moves in axial of the collet and the second guide surface is transversely disposed to the path of member movement.

7. The apparatus of claim 1 wherein the path along which the member moves is axial of the collet and the recess is traversely disposed to the path of member movement.

8. The apparatus of claim 1 including movable support means for holding the member.

9. The apparatus of claim 8 wherein the movable support means includes an air cylinder.

10. Apparatus for packaging strand comprising:

a. a driven rotatable collet having a first package collection region for collecting a first strand, a second package collection region for collecting a second strand and a temporary collection region;

b. a strand engaging member having a recess, a first guide surface and a second guide surface;

c. means for moving the member along a path to move the first strand and the second strand from the package collection regions to the temporary collection region, the first guide surface being adapted to contact and guide the first strand toward the recess and the second guide surface being adapted to contact the second strand as the member is moved to move the strands to the temporary collection region;

d. means for moving the member to move the first strand and the second strand from the temporary collection region to the package collection regions, the second strand being moved to its package collection region and being removed from the second guide surface while the first strand remains in the recess and then the first strand being moved to its package collection region and being removed from the recess; and e. a lift-out means for removing the first strand from the recess as the first strand is moved from the temporary collection region to the first package collection region.

* * * * *